United States Patent [19]

Seragnoli

[11] 4,418,705

[45] Dec. 6, 1983

[54] METHOD AND RELATIVE MANUFACTURING MACHINE FOR SIMULTANEOUSLY PRODUCING TWO CONTINUOUS CIGARETTE RODS

[75] Inventor: Enzo Seragnoli, Bologna, Italy

[73] Assignee: G. D. Societa per Azioni, Bologna, Italy

[21] Appl. No.: 330,564

[22] Filed: Dec. 14, 1981

Related U.S. Application Data

[62] Division of Ser. No. 149,000, May 12, 1980, Pat. No. 4,336,812.

[30] Foreign Application Priority Data

May 22, 1979 [IT] Italy ..... 49133 A/69

[51] Int. Cl.[3] ..... A24C 5/14; A24C 5/18; A24C 5/39

[52] U.S. Cl. ..... 131/84 R

[58] Field of Search ..... 131/280, 281, 282, 284, 131/32, 33, 3 X, 35, 36, 60, 65, 66, 67, 68, 69, 84 R, 84 A, 84 B, 84 C, 109 B, 109, AB, 110

[56] References Cited

U.S. PATENT DOCUMENTS

| | | | |
|---|---|---|---|
| 3,525,344 | 8/1970 | Neuber | 131/84 R |
| 3,850,177 | 11/1974 | Labbe | 131/84 R |
| 4,033,360 | 7/1977 | Nienow et al. | 131/84 R |
| 4,041,959 | 8/1977 | Garrone | 131/84 R |

*Primary Examiner*—V. Millin

*Attorney, Agent, or Firm*—Merriam, Marshall & Bicknell

[57] ABSTRACT

A method for simultaneously producing two continuous cigarette rods is described.

The main feature of this method is to comprise two simultaneous successions of stages, the first for forming two equal strips of paper starting from a single continuous web, and the second for forming two substantially uniform and equal fillers of shredded tobacco starting from a single inlet hopper.

8 Claims, 10 Drawing Figures

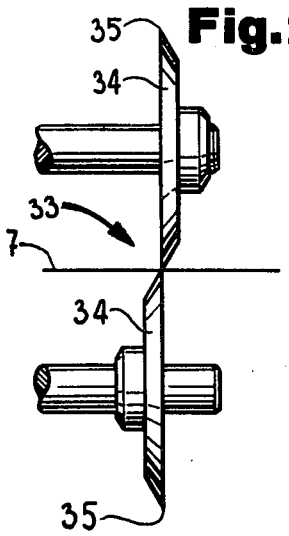
Fig.2
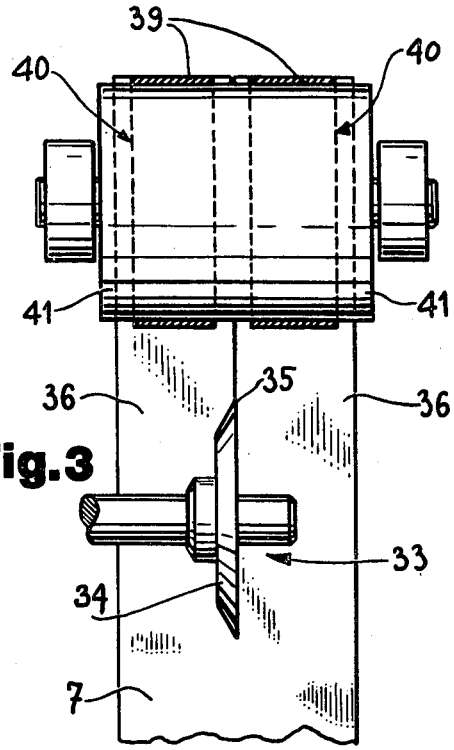
Fig.3
Fig.4
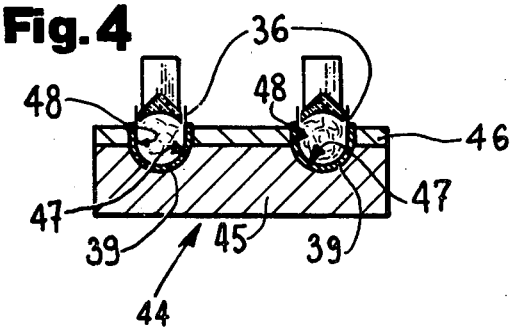
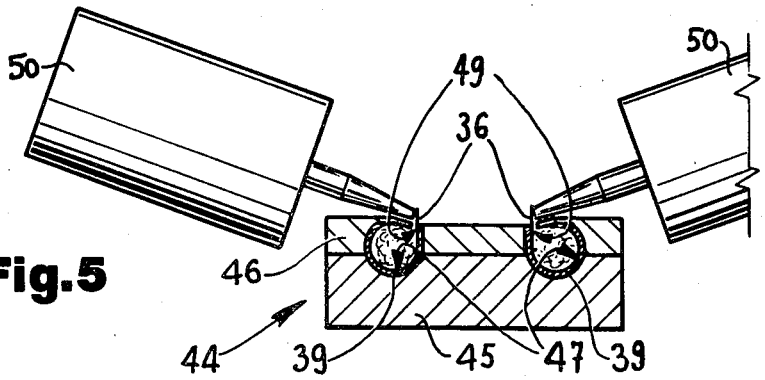
Fig.5

METHOD AND RELATIVE MANUFACTURING MACHINE FOR SIMULTANEOUSLY PRODUCING TWO CONTINUOUS CIGARETTE RODS

This is a division of application Ser. No. 149,000 filed May 12, 1980, now U.S. Pat. No. 4,336,812.

BACKGROUND OF THE INVENTION

This invention relates to a method for simultaneously producing two continuous cigarette rods.

In manufacturing cigarettes, it is known to produce a continuous cigarette rod starting from a paper web mounted on a spool and from a stock of shredded tobacco. The continuous rod produced in this manner is then divided by transverse cuts into cigarettes which after passing through possible successive stages such as the addition of a filter, are fed to a packaging machine.

Following the recent construction of very fast packaging machines able to produce ten or more packets of cigarettes per second, it has become necessary to design a new cigarette manufacturing machine which is capable by itself of feeding a modern packaging machine.

Up to the present time, this problem has remained unsolved, and the fast packaging machines are normally connected to two manufacturing machines disposed in parallel, each being able to produce a continuous cigarette rod.

Although the method heretofore described is functional, it involves considerable cost due mainly to the duplication not only of the mechanical members but also of the controls and operating personnel.

SUMMARY OF THE INVENTION

The object of the present invention is to substantially double the production capacity of known manufacturing machines without making any substantial additions to the production cost, by simultaneously producing two continuous cigarette rods starting from a single paper web and a single stock of shredded tobacco.

According to the present invention there is provided a method for simultaneously producing two continuous cigarette rods, characterized by comprising two simultaneous successions of stages, the first for forming two equal strips of paper starting from a single continuous web, and the second for forming two substantially uniform and equal fillers of shredded tobacco starting from a single inlet hopper; said first succession comprising the following stages: feeding said continuous paper web along a determined path to a cutting position; marking equal graphical signs upstream of said cutting position on each side of the longitudinal axis through the web; longitudinally cutting said web at said cutting position into two equal strips; feeding said two strips along separate paths through respective loading positions at which a respective said filler of shredded tobacco is fed on to each of said strips; and turning the opposing lateral edges of each of said strips towards each other and then joining them together downstream of the respective said loading station; and said second succession comprising the following stages:

withdrawing the shredded tobacco from said hopper in such a manner as to provide a continuous substantially uniform stream of tobacco; dividing said stream into two substantially equal streams;

feeding each of said two streams to below a respective suction conveyor belt to form said two uniform fillers of shredded tobacco; and feeding said two fillers to said respective loading positions.

BRIEF DESCRIPTION OF THE DRAWINGS

The invention will be described by way of example with reference to the accompanying drawings, in which:

FIG. 2 is a section on the line II—II of FIG. 1;

FIG. 3 is a section on the line III—III of FIG. 1;

FIG. 4 is a section on the line IV—IV of FIG. 1;

FIG. 5 is a section on the line V—V of FIG. 1;

FIG. 1 shows a cigarette manufacturing machine 1 comprising a feed unit 2 for paper in web form, and a feed unit 3 for shredded tobacco.

Figure 1:
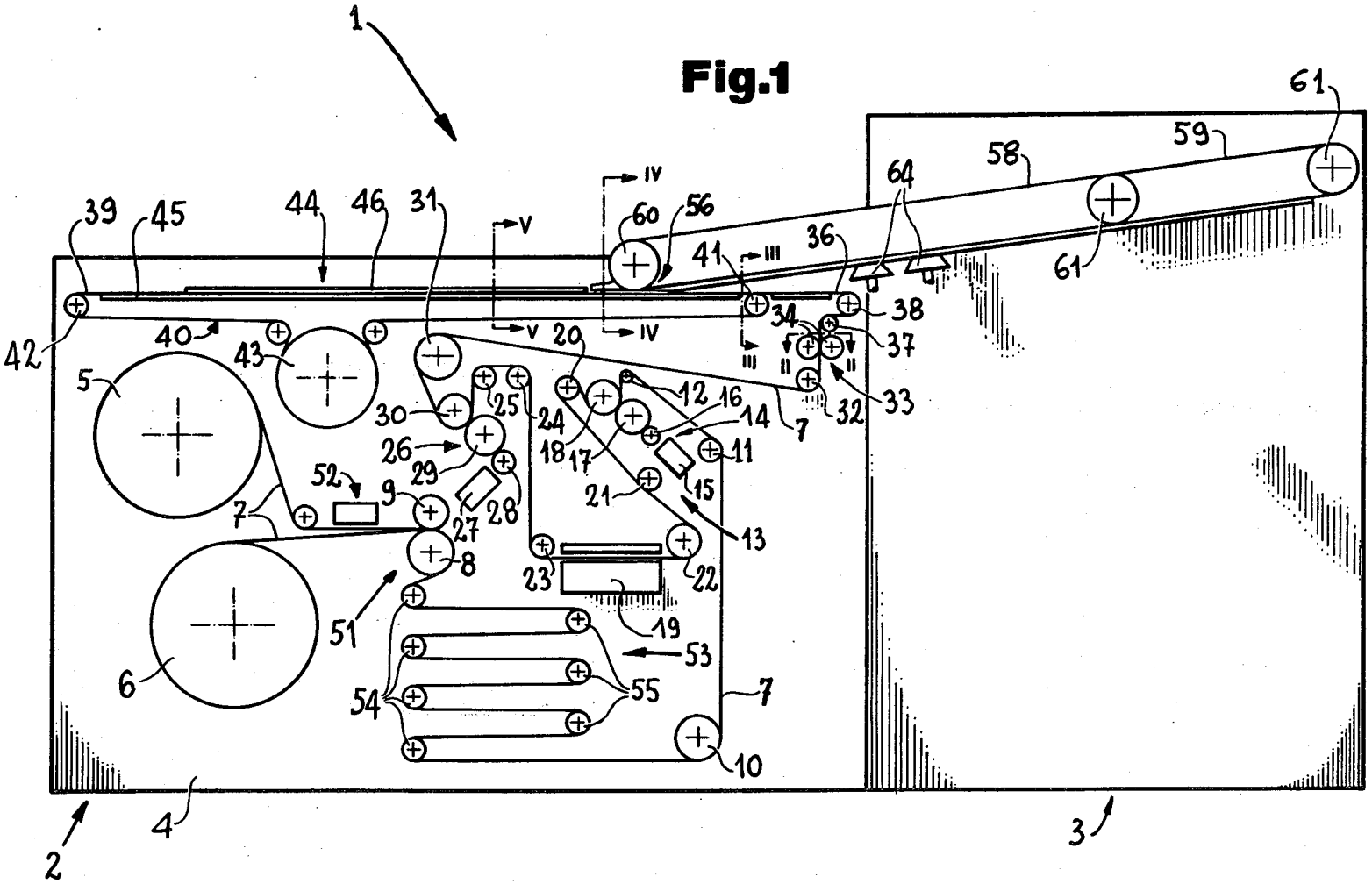
FIG. 1 is a diagrammatic axial secton in partial block form through a manufacturing machine constructed to implement the method of the present invention.

The feed unit 2 comprises a base 4, on the outside of which are mounted two superposed spools 5 and 6 rotatable about horizontal axes. Each spool 5, 6 supports a paper web 7, the width of which is slightly greater than double the circumference of the cigarettes to be produced.

When in operation, only one of the webs 7 is unwound continuously from the relative spool 5, 6, and is fed by way of a thrust roller 8, a pressure roller 9 and deviation rollers 10, 11 and 12, to a first printing unit 13 known as a "bronzing device", which is arranged to mark graphical signs of gold or similar color on said web 7. In particular, the bronzing device 13 is arranged to mark on said web 7 two sets of equal graphical signs (not shown) disposed on opposite sides of the longitudinal axis of the web 7.

The bronzing device 13 illustrated is of known type, and comprises a sizing device 14 constituted by a dispenser 15, by which the size is fed by means of a roller 16 to a printing roller 17, the periphery of which is kept in contact with one surface of the web 7 by a pressure roller 18. The printing roller 17 is configured such as to apply size to the web 7 at those points in which said golden graphical signs are to be marked. These latter are obtained by feeding purpurin or another powdered dye on to the web 7 by means of a dispensing device 19, to which the web leaving the sizing device 14 is fed by the deviation rollers 20, 21 and 22.

Inside the dispensing device 19, the powdered dye is brought into contact with the web 7 and adheres to it only at those points covered with size, so reproducing the required graphical signs.

The web 7 leaving the dispensing device 19 is fed by deviation rollers 23, 24 and 25 to a second printing unit 26 of known type, comprising a dispenser 27 which feeds ink by way of an inking roller 28 to a printing roller 29, the periphery of which is kept in contact with one surface of the web 7 by means of a pressure roller 30. The printing roller 29 is configured such as to mark with ink two sets of equal graphical signs (not shown) on opposite sides of the longitudinal axis of the web 7.

The web 7 leaving the printing unit 26 is fed by deviation rollers 31 and 32 to a cutting station 33 shown in detail in FIGS. 2 and 3, and comprising two substantially coplanar counter-rotating discs 34 disposed tangential to each other and rotatable about respective horizontal axes. The discs 34 each comprise a circular cutting edge 35 disposed in a plane perpendicular to the plane of the web 7, and passing through the longitudinal axis thereof.

As it passes between the discs 34, the web 7 is divided into two equal strips 36 which are fed by deviation rollers 37 and 38 on to the upper branch 39 of a respective endless conveyor belt 40 passing over two pulleys 41 and 42 and driven by a drive roller 43.

The upper branch 39 of each conveyor belt 40 extends along a bench 44 disposed at the top of the base 4 and comprising two superposed plates 45 and 46. As shown in FIGS. 4 and 5, the lowerly disposed plate 45 is longer than the plate 46, and is provided with two upper grooves 47, each of which, in cross-section, is of curved shape with a varying radius of curvature which is inversely proportional to the distance from the cutting station 33, said cross-section assuming a substantially semi-cylindrical constant shape at its end, having a radius of curvature substantially equal to that of the cigarettes to be formed.

The upper plate 46 comprises two slots 48 extending along the grooves 47 and having a width which decreases as the distance from the cutting station 33 increases, until it is reduced to a simple vertical slit 49 (FIG. 5).

As shown in FIGS. 4 and 5, the upper branch 39 of each belt 40 extends along a respective groove 47, in contact with which it curves progressively inwards until, cooperating with the respective slot 48, it assumes a substantially cylindrical shape.

Because of the transverse deformation of the belts 40, the strips 36 are also deformed transversely until they form a continuous cylinder. Immediately before assuming said final cylindrical form, each strip 46 projects by one of its lateral edges through the relative vertical slit 49 (FIG. 5), and comes into contact with a respective gumming device 50. Immediately downstream of the gumming device 50, said lateral edge is bent over, by means not shown, on to the opposing lateral edge, t which it adheres so as to give the strip 36 a stable cylindrical form.

As stated heretofore, only one of the webs 7 is unwound from the relative spool 5, 6, while the other web 7 remains stationary, and is used only when the moving spool 5, 6 is empty.

For this purpose, the machine 1 is provided with an automatic spool change-over device 51 of known type, comprising a splicing element 52 through which both the moving web 7 and the end of the stationary web 7 extend. When sensors, not shown, detect that the moving spool 5, 6 is nearly empty, the moving web 7 is cut by means of a cutting device, not shown, and its end is glued to the beginning of the stationary web 7 inside the element 52. In order to enable the end of the moving web 7 to stop for a certain time inside the element 52 without this causing any interruption in the production, the device 51 comprises a store 53 consisting of a first plurality of rollers 54 disposed one above the other and rotatable about fixed horizontal axes, and a second plurality of rollers 55 disposed to the side of the rollers 54 and mounted rotatable about horizontal axes which are mobile transversely towards the rollers 54 against the action of resilient means, not shown. The moving web 7 is wound alternately around the rollers 54 and 55 in such a manner as to form a zig-zag arrangement, which flattens out by the rollers 55 approaching the rollers 54 when the end of the moving web 7 is arrested inside the element 52, so enabling the machine 1 to operate for the relatively short time necessary for splicing the webs 7.

Figure 7:
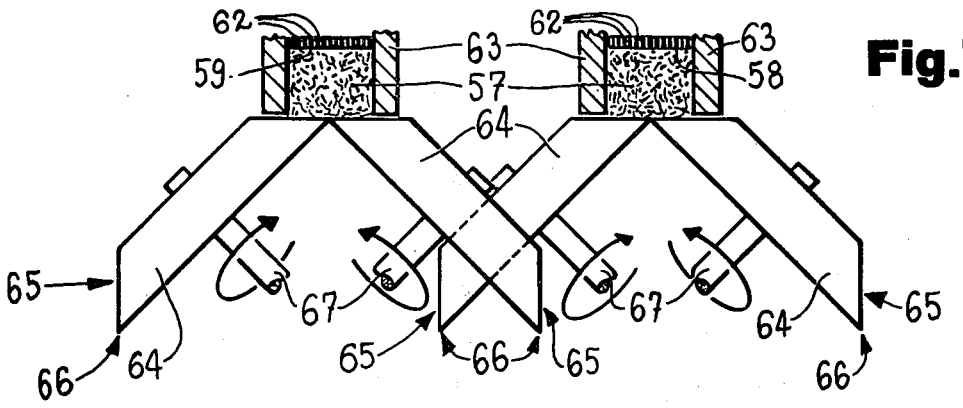
FIG. 7 is a section on the line VII—VII of FIG. 6.
Figure 6:
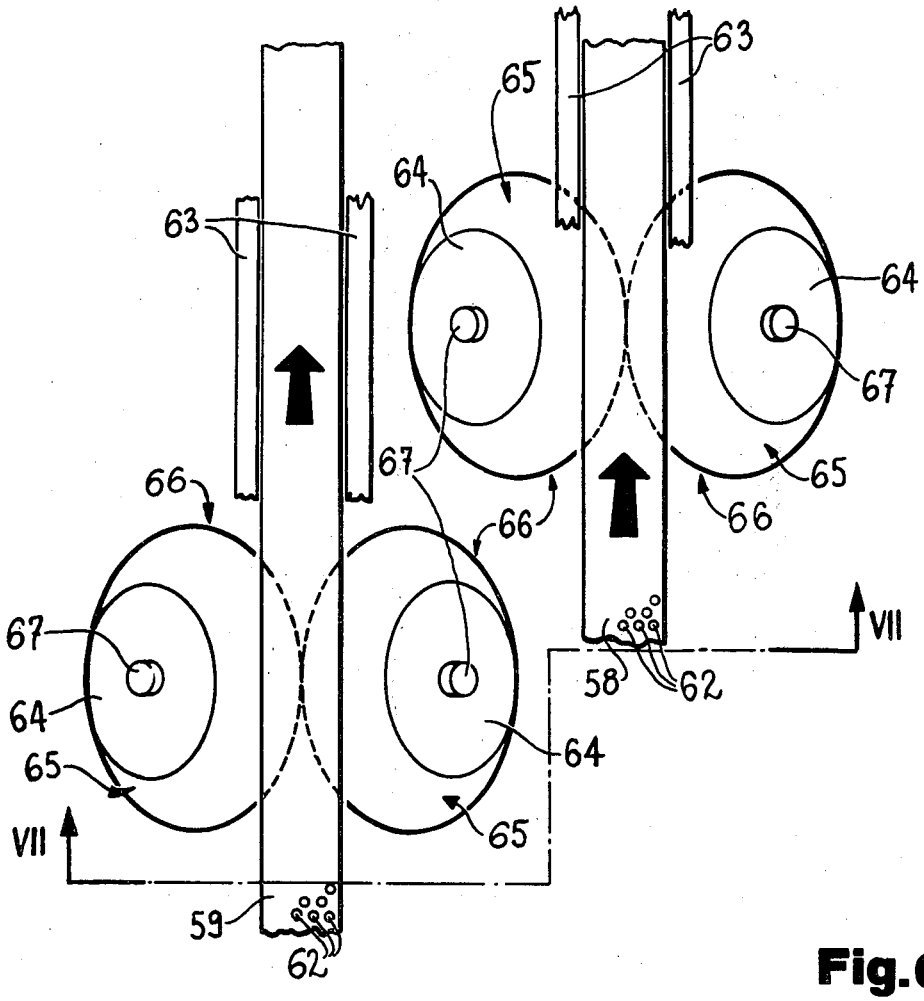
FIG. 6 is a plan view to an enlarged scale of a first detail of FIG. 1.

As shown in FIGS. 1 and 7, a substantially uniform filler 57 (FIG. 7) of shredded tobacco is fed on to the upper branch 39 of each conveyor belt 40 at a loading station 56 disposed above the plate 45 in a point immediately upstream of the beginning of the plate 46.

The fillers 57 are substantially equal to each other and adhere to the lower surface of the lower branch of respective suction conveyor belts 58 and 59 forming part of the feed unit 3 and extending beyond this latter and above the bench 44.

The belts 58 and 59 are inclined downwards, and each wind about a lower pulley 60 disposed at the loading station 56, and an upper pulley 61. The two pulleys 60 are disposed coaxially, whereas the two pulleys 61 are offset because the belt 59 is longer than the belt 58.

The two fillers 57 are kept in contact with the respective belts 58 and 59 by the effect of compressed air flowing from the bottom upwards through perforations 62 (FIG. 7) provided in the belts 58 and 59. The dimensions of the cross-section of each filler 57 are exactly defined (FIG. 7) laterally by two lateral walls 63, between which extends the lower branch of each belt 58, 59, and lowerly by a pair of trimmer discs 64 arranged to shave the lower surface of said filler 57.

Figure 9:
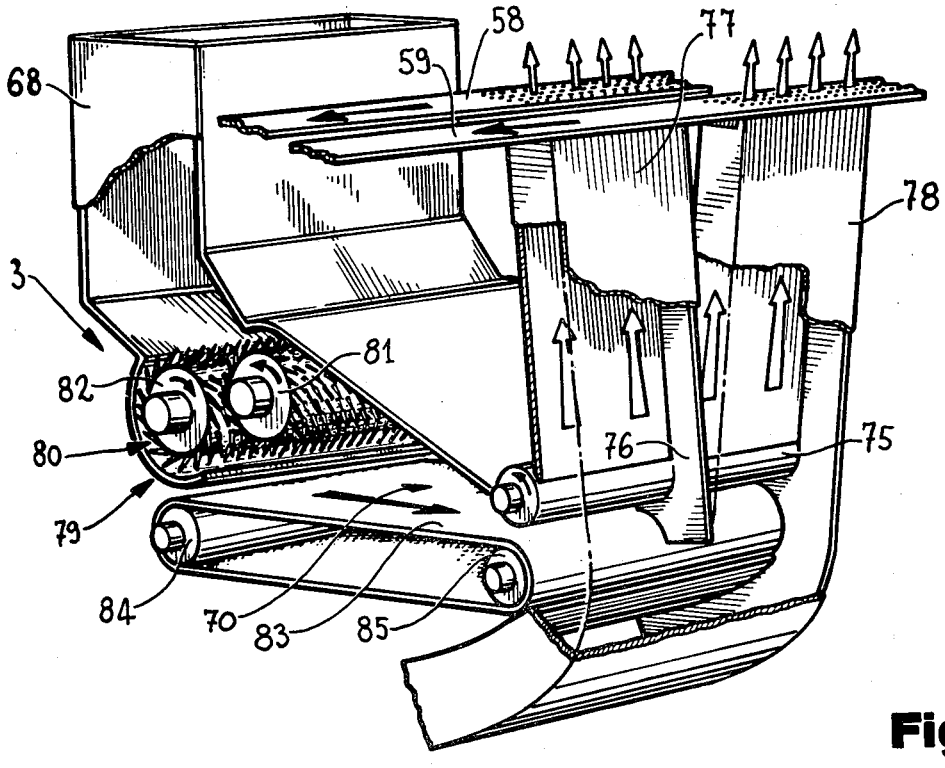
FIG. 9 is a perspective view of a modification of the distributor of FIG. 8.
Figure 10:
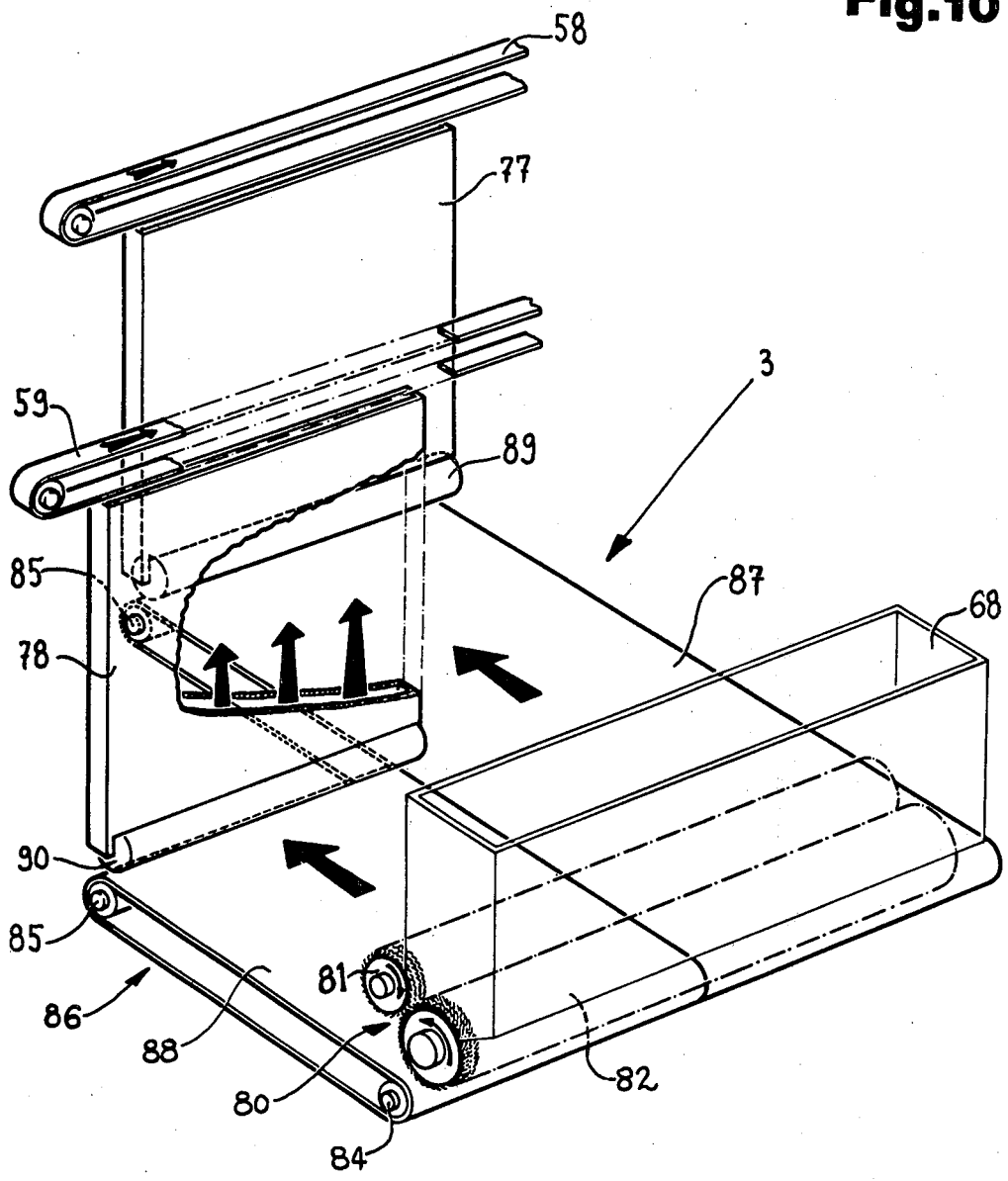
FIG. 10 is a perspective view, with parts removed for clarity, of a second embodiment of the tobacco distributor unit of the machine of FIG. 1.

As shown in FIGS. 9 and 10, each trimmer disc 64 is bounded externally by a cone-frustam surface 65 with a cutting edge 66 along its major base. The two discs 64 serving each filler 57 are disposed with their cutting edges 66 tangential to each other, and with their cone-frustum surfaces 56 in a position which is tangential, along one of their generating lines, to the lower surface of the relative filler 57, and are keyed on to respective counter-rotating shafts 67 disposed inclined towards each other in a downward direction.

With regard to the aforegoing, it should be noted that the cone-frustum shape of the discs 64 and their inclined position enables the belts 58 and 59 to be disposed not only close to each other but also side-by-side.

A similar arrangement would not be possible if flat or horizontal trimmer discs were used, because in such a case one of the trimmer discs of each filler 57 would also influence the other filler 57, so twisting it.

According to a modificaion, not shown, the inclined position of the two discs 64 also makes it possible to use a single suction conveyor belt of double width, arranged to support both fillers 57 in very close adjacent positions.

Figure 8:
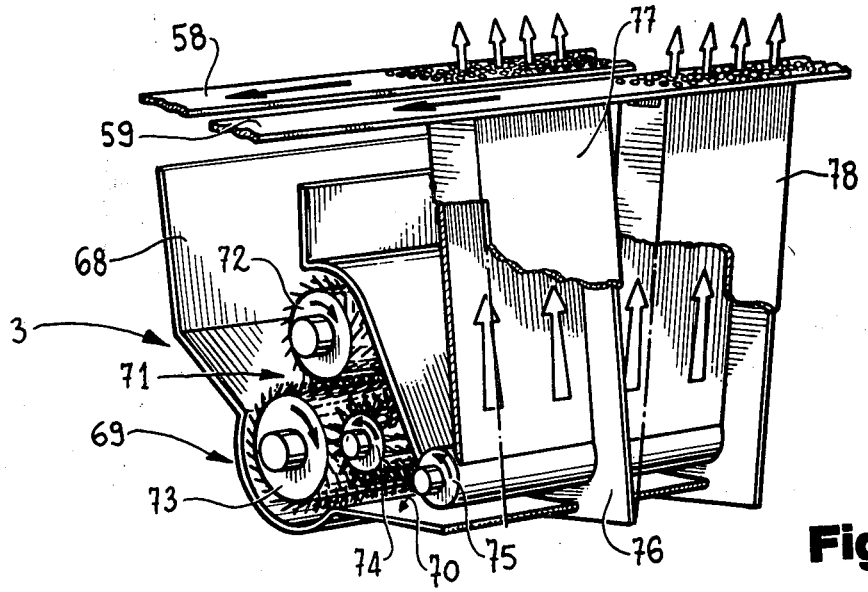
FIG. 8 is a perspective view, with parts removed for clarity, of a first embodiment of a tobacco distributor unit forming part of the machine of FIG. 1.

As shown in FIG. 8, the two fillers 57 are prepared from a stock (not shown) of curved and shredded tobacco fed into an inlet hopper 68 and from there to a distributor device 69 forming part of the feed unit 3. The distributor unit 69 comprises a substantially horizontal channel 70 extending from a lower aperture in the hopper 68 and enclosing internally a carding unit 71 consisting of two superposed carding rollers 72 and 73 rotatable in the same direction about horizontal axes, and a withdrawal roller 74 tangential to the roller 73 and rotating in the opposite direction to this latter.

The roller 74 is arranged to withdraw the tobacco adhering to the roller 73, and to urge it along the channel 70 towards a thrust roller 75 disposed horizontally and transversely inside the channel 70 at that end thereof distant from the end connected to the hopper 68. At the roller 75, the channel 70 is divided into two equal parts by a vertical wall 76 perpendicular to the axis of the roller 75, and communicates with the lower end of two equal channels 77 and 78, which extend upwards from opposite sides of the wall 76 and are disposed in a V arrangement to each other. The channels 77 and 78 are traversed by ascending compressed air streams fed by a source, not shown, and are closed at their upper end by the lower branch of the suction conveyor belts 58 and 59 respectively.

When in operation, the cured and shredded tobacco extracted from the hopper 68 by the carding rollers 72 and 73 is fed by the withdrawal roller 74 along the channel 70 to form on the base thereof a uniform layer, which is divided longitudinally into two equal parts by the wall 76. Each of said parts is then thrust into the respective channel 77, 78 by the thrust cylinder 75, and is fed on to the respective suction conveyor 58, 59 to form the relative filler 57. This latter is fed by the relative conveyor belt 58, 59 to the loading station 56, from which it is released on to the relative strip 36.

This latter runs along the plate 45 and turns over below the plate 46 to wrap the relative filler of tobacco 57 in order to form a continuous cigarette rod of substantially cylindrical shape which is then divided by cutting means, not shown, to form the individual cigarettes.

The modification shown in FIG. 9 relates to a distributor 79 very similar to the distributor 69, from which it differs by comprising a carding unit 80 comprising only two counter-rotating horizontal carding rollers 81 and 82, and by the fact that the base wall of the channel 70 on to which the tobacco is fed by the carding unit 80 is constituted by the upper branch of a conveyor belt 83, which is endlessly wound about two rollers 84 and 85 and feeds the tobacco leaving the carding unit 80 to the thrust roller 75.

The embodiment shown in FIG. 10 relates to a distributor 86 very similar to the distributor 79, from which it differs by the fact that the two channels 77 and 78 are disposed vertically parallel to each other in offset positions instead of being disposed in V-form. In addition, in contrast to the distributor 79, the conveyor 83 of FIG. 9 is replaced in the distributor 86 by two separate conveyors 87 and 88 of different lengths, which are wound about respective rollers 84 and 85 and terminate below respective thrust rollers 89 and 90 disposed at the lower end of the channels 77 and 78 respectively.

From FIG. 10, it is apparent that by varying the lengths of the conveyors 87 and 88, it is possible to vary the distance between the channels 77 and 78, and thus the distance between the suction conveyor belts 58 and 59. By means of the distributor 86, it is therefore possible to provide a manufacturing machine in which the cigarette rods are formed in adjacent positions, or in positions disposed on the same side of the machine but at a relative distance from each other, or on benches disposed on opposite sides of the machines.

What we claim is:

1. A method for simultaneously producing two continuous cigarette rods, characterized by comprising two simultaneous successions of stages, the first for forming two equal strips (36) of paper starting from a single continuous web (7), and the second for forming two substantially uniform and equal fillers (57) of shredded tobacco starting from a single inlet hopper (68); said first succession comprising the following stages:

feeding said continuous paper web (7) along a determined path to a cutting position (33);

marking equal graphical signs on said web upstream of said cutting position (33) on each side of the longitudinal axis through the web (7);

longitudinally cutting said web at said cutting position (33) into two equal strips (36);

feeding said two strips (36) along separate paths through respective loading positions (56) at which a respective said filler (57) of shredded tobacco is fed on to each of said strips (36); and turning the opposing lateral edges of each of said strips (36) towards each other and then joining them together;

and said second succession comprising the following stages:

withdrawing the shredded tobacco from said hopper (68) in such a manner as to provide a continuous substantially uniform stream of tobacco;

dividing said stream into two substantially equal streams; feeding each of said two streams to below a respective suction conveyor belt (58–59) to form said two uniform fillers (57) of shredded tobacco; and feeding said two fillers to said respective loading positions (56).

2. A method as claimed in claim 1, wherein each said stream is advanced so as to cooperate with respective trimmer means (64); said trimmer means (64) being disposed below each of said suction conveyor belts (58–59) in order to control the thickness of said fillers.

3. A method as claimed in claim 2, wherein said trimmer means comprise, for each of said suction conveyor belts (58–59), a pair of discs (64) each of which comprises an external cone-frustum surface (65) provided with a cutting edge (66) at its major base; said two discs (64) being disposed with their cutting edges (66) in a tangential position to each other and being mounted to rotate about shafts (67) which are inclined downwards towards each other, said two cone-frustum surfaces (65) being both tangential to the lower surface of the relative filler (57) along one of their generating lines.

4. A method as claimed in claim 1, wherein said uniform stream of shredded tobacco withdrawn from said hopper (68) is divided into said two streams by means of distributor means comprising a first channel (70) extending from said hopper (68), a carding unit (71–80) for forming a stream of shredded tobacco along said channel, wall means (76) disposed inside said channel (70) to divide said stream into two substantially equal streams, and two second channels (77–78) facing upwards; each of said two second channels (77–78) being arranged to receive one of said two streams, and terminating below a respective said suction conveying belt (58–59).

5. A method as claimed in claim 4, wherein said two second channels (77–78) are disposed side-by-side in a V arrangement with the vertex pointing downwards.

6. A method as claimed in claim 4, characterized in that the lower wall of said first channel (70) is constituted at least partly by the upper branch of an endless conveyor (83).

7. A method as claimed in claim 4, characterized in that said two second channels (77–78) are disposed offset to each other at different distances from said carding unit (80).

8. A method as claimed in claim 7, characterized in that the lower wall of said first channel (70) is constituted at least partly by the upper side-by-side branches of two endless conveyors (87–88) of equal width but different length.

* * * * *